US005701860A

United States Patent [19]

Horiuchi et al.

[11] Patent Number: 5,701,860

[45] Date of Patent: Dec. 30, 1997

[54] DECOMPRESSOR FOR AN INTERNAL COMBUSTION ENGINE

[75] Inventors: Hiroshi Horiuchi; Yuichi Momose; Takeshi Ushikoshi, all of Matsumoto, Japan

[73] Assignee: Ishikawajima-shibaura Machinery Co., Ltd., Tokyo, Japan

[21] Appl. No.: 692,214

[22] Filed: Aug. 5, 1996

[30] Foreign Application Priority Data

Mar. 26, 1996 [JP] Japan ..... HEI 8-070233

[51] Int. Cl.[6] ..... F02N 3/02; F02N 17/08

[52] U.S. Cl. ..... 123/182.1

[58] Field of Search ..... 123/182.1

[56] References Cited

U.S. PATENT DOCUMENTS

| | | | |
|---|---|---|---|
| 2,947,300 | 8/1960 | Trapp | 123/182.1 |
| 5,116,287 | 5/1992 | Hironaka et al. | 123/182.1 |
| 5,361,738 | 11/1994 | Iida | 123/182.1 |
| 5,379,734 | 1/1995 | Tsunoda et al. | 123/182.1 |

FOREIGN PATENT DOCUMENTS

| | | |
|---|---|---|
| 2-176159 | 7/1990 | Japan . |
| 6-49900 | 11/1990 | Japan . |
| 3-121267 | 5/1991 | Japan . |

*Primary Examiner*—Andrew M. Dolinar

*Attorney, Agent, or Firm*—Jordan and Hamburg

[57] ABSTRACT

A decompressor disposed to start an engine by a recoil starter and at this time compression pressure within a cylinder is adapted to escape therefrom, in which a decompression valve of the decompressor is disposed vertically with respect to a crank shaft or within a crank casing, so that a decompression valve does not laterally project from the cylinder and does not interfere with a cowling, whereby a compact engine is laid out, and also an interlocking mechanism of the decompression valve with the recoil starter becomes simple. Furthermore, a cam at the recoil reel is made variable correspondingly to the kind of engine so that the decompression timing during the starting is made variable so as to obtain the most suitable starting mechanism.

4 Claims, 7 Drawing Sheets

DECOMPRESSOR FOR AN INTERNAL COMBUSTION ENGINE

BACKGROUND OF THE INVENTION

The present invention relates to an internal combustion engine started by a recoil starter, in which, when the recoil starter is actuated, a decompression valve is automatically open.

Conventionally, when a diesel engine is to be started, in order to rotate a crank shaft with ease, it has been well-known that a decompressor is provided so that the crank shaft is rotated in the incompressible state. When a flywheel increases its torque, a decompression valve is closed to start the engine. A recoil starter for the internal combustion engine is adapted to start the engine wherein, when a recoil reel of the recoil starter is rotated, the decompression valve is open. For example, the former is disclosed in the Japanese Utility Model Publication No. Hei 6-49900 and the U.S. Pat. No. 5,116,287 and the latter in the Japanese Patent Laid-Open No. Hei 2-176159.

Conventionally the decompressor is mounted to a cylinder head at the engine and connected with the recoil starter so as to automatically open the compression valve when a starting cord is pulled. A coupling mechanism, such as a link, is required to be interposed between the decompression valve and the recoil starter. The link mechanism, interposed between the cylinder head and the recoil starter, becomes larger with increased engine size and a space for housing therein the link mechanism becomes larger, resulting in that the engine becomes larger as a whole.

As shown in FIG. 10, when the decompression valve 1 is disposed at the lateral side of a cylinder 3 instead of extending in parallel to a crank shaft 2, the decompressor largely projects from the cylinder 3, whereby a cowling 4 must largely be changed in design. When a lever or the like, for transmitting the motion of a recoil starter to the decompressor, is provided at the recoil casing, a cutout must be provided thereon. Dust or the like is liable to enter into the recoil casing from the cutout and inconvenience is caused in the rotation or sliding motion of the recoil. Also, a transmitting device is provided, so that the entire recoil starter becomes large-sized and the entire engine becomes large-sized due to these accessories.

SUMMARY OF THE INVENTION

The present invention has been so designed that a recoil starter can start an engine and a decompression valve is disposed in a cylinder head, so that, when the engine starts, the compression valve is open to rotate a crank shaft with ease, in which, when the decompression valve is vertically disposed with respect to the crank shaft between the cylinder and the crank casing or is disposed therein, so that the decompression valve may be open following the rotation of recoil reel to enable the compression pressure within the cylinder to be released. Accordingly, when the starting cord is pulled and the recoil reel is rotated to start the engine, an operating rod is pressed to push open the decompression valve and the crank shaft easily rotates to start the engine. The operating rod for operating the decompression valve and the decompression valve extend not in parallel to the crank shaft, but vertically disposed, whereby an operating portion of the decompression valve does not laterally project from the cylinder to thereby obtain an engine of compact type.

Also, the operating rod for connecting the recoil starter and decompression valve is disposed within a cowling to prevent dust from entering into the operating portion, thereby enabling the starting operation to be stabilized.

In order to push the operating rod to open the decompression valve, a cam provided at the lateral side of the recoil reel is variable correspondingly to the kind of the engine, thereby enabling a suitable recoil starter to be constructed.

The above and other related objects and features of the invention will be apparent from a reading of the following description of the disclosure found in the accompanying drawings and the novelty thereof pointed out in the appended claims.

DESCRIPTION OF THE PREFERRED EMBODIMENT

Figure 1:
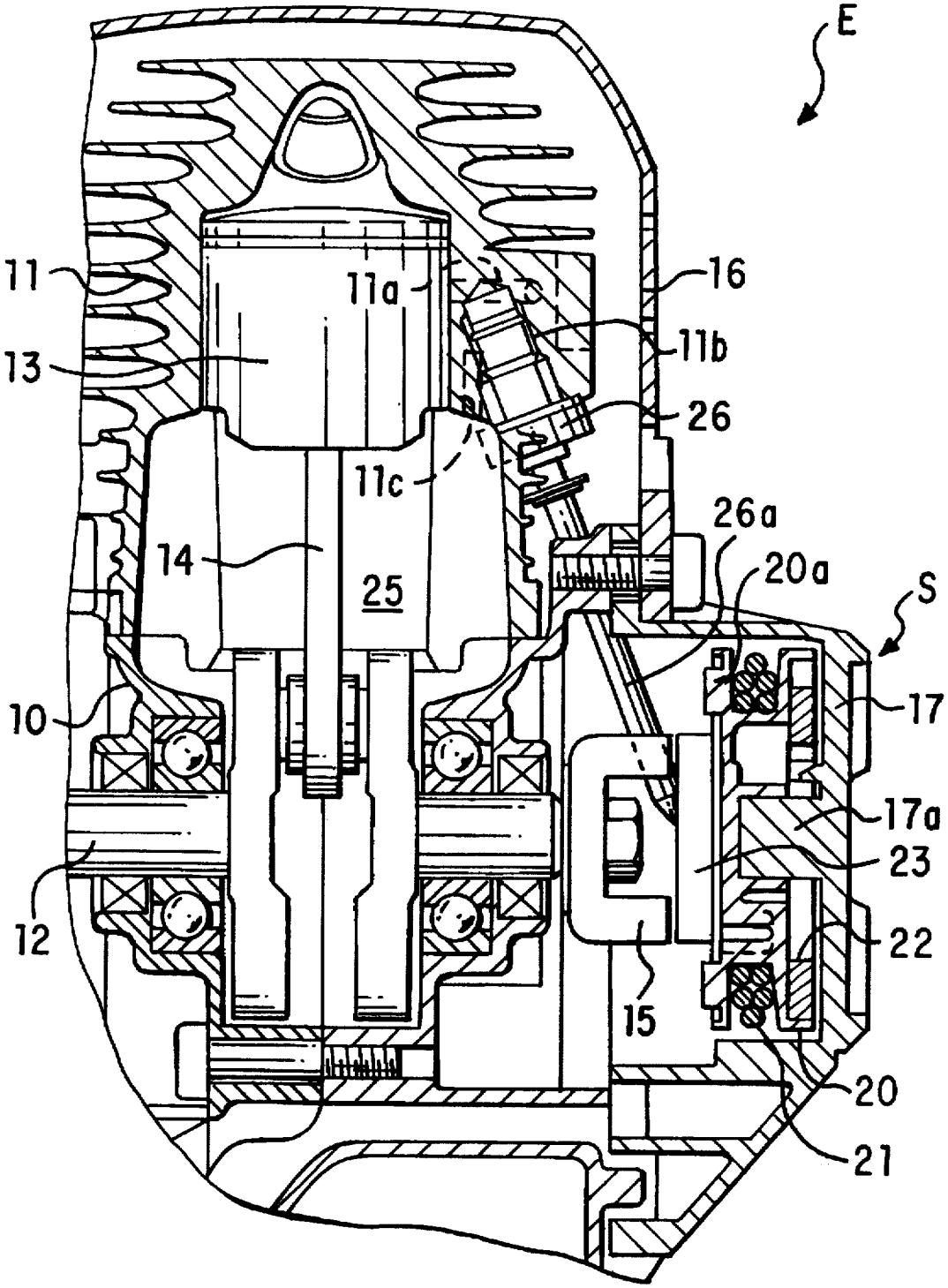
FIG. 1 is a partial cross-sectional front view of an engine of a first embodiment of the present invention.
Figure 2:
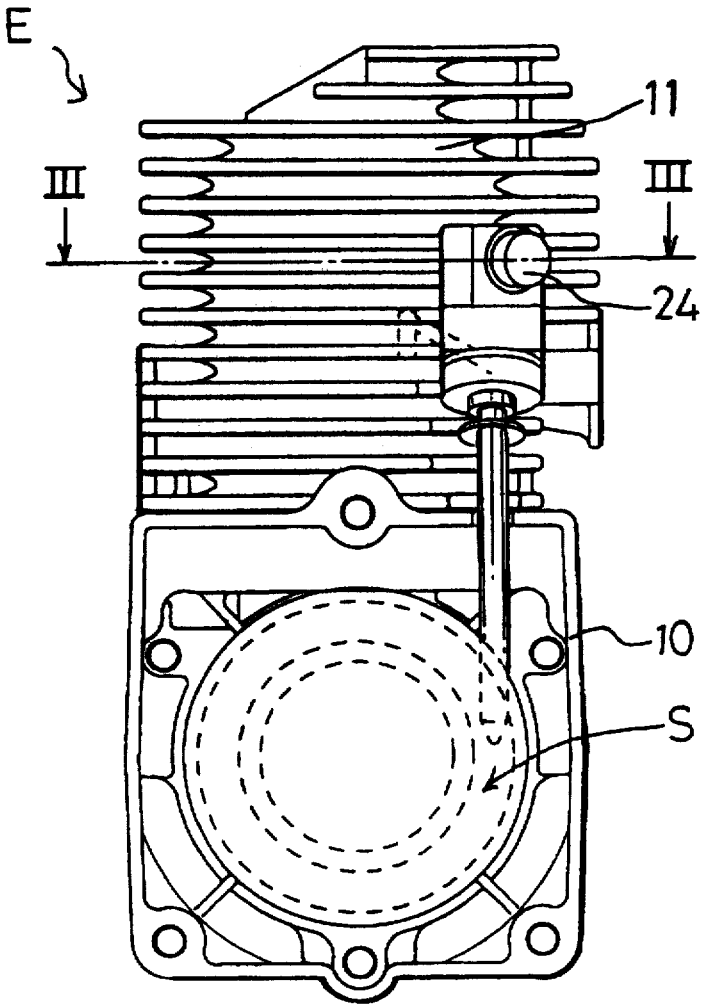
FIG. 2 is a partial side view of the embodiment of FIG. 1.
Figure 3:
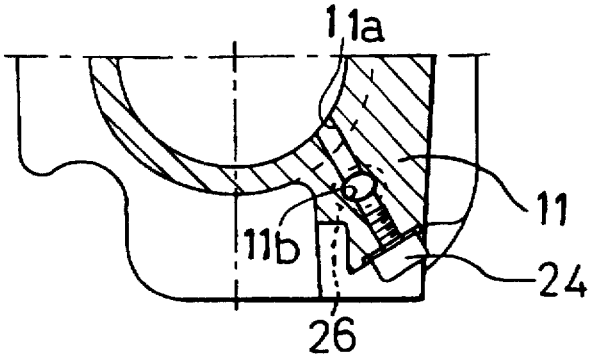
FIG. 3 is a partial cross-sectional view looking in the direction of the arrows III—III in FIG. 2.

Referring to FIGS. 1 through 5, explanation will be given of a first embodiment of the present invention follows. An engine E is so constructed that a cylinder 11 is fixedly loaded on a crank casing 10, a crank shaft 12 is rotatably horizontally supported through bearings in the crank casing 10, a piston 13 is inserted into the cylinder 11 vertically with respect to the crank shaft 12, and the piston 13 and crank shaft 12 are rotatably connected with each other through a connecting rod 14. The crank shaft 12 fixes at one axial end thereof a pulley and a flywheel( not shown) for taking out power and at the other axial end a starter pulley 15.

A top and a lateral side of the cylinder 11 are covered by a cowling 16A coil casing 17 is fixed to the lower portion of the cowling 16 and, the recoil casing 17 houses therein a recoil starter S having a support shaft 17*a* inwardly projection from an inner surface of the recoil casing 17 and coinciding with the axis of the crank shaft 12A recoil reel 20 is rotatably pivoted onto the support shaft 17*a*, and a starting cord 21 is wound around the recoil reel 20 and one end of the cord 21 is fixed to the recoil reel 20 and the other end is taken out from the recoil casing 17 and fixed to a handle ( not shown). A spring 22 is interposed between an outside surface of the recoil reel 20 and the inner surface of the recoil casing 17 so as to bias the recoil reel 20 in a direction for winding up the starting cord 21. At the axial center of the inner surface of the recoil reel 20 is disposed a slidable member 23 having a cam, so that, when the recoil reel 20 is rotated by pulling the starting cord 21, the slidable member 23 is adapted to slide toward the crank shaft 12 by means of the cam. Furthermore, between the inner surface of the slidable member 23 and the side surface of the starter pulley 15 is formed a one-way clutch, such as teeth or ratchets.

In the recoil starter S of such construction that when the starting cord 21 is pulled, the recoil reel 20 is rotated to push the cam to slide the slidable member 23 toward the starter pulley 15, whereby the slidable member 23 engages with the starter pulley 15 to enable the crank shaft 12 to rotate. After the engine starts, the starter pulley 15 idles with respect to the recoil reel 20 through the one-way clutch, the recoil reel 20 being reversely rotated by the spring 22 so that the starting cord 21 is wound and the slidable member 23 slides toward the recoil reel 20.

The decompressor of the present invention is interposed between the cylinder 11 and the recoil starter S. A decompression port 11*a* is open at a side surface of the cylinder 11 and the outside thereof is closed by a plug 24. At the cylinder 11 is formed a valve insertion bore 11*b*, inwardly slanting and upwardly extending toward the decompression port 11*a*. The valve insertion bore 11*b* communicates with a crank housing interior 25 through a communicating bore 11*c*. A decompression valve 26 is inserted into the valve insertion bore 11*b*, and a valve operating rod 26*a* projects downwardly from the decompression valve 26, which is normally closed and which is open by pressing the operating rod 26*a*, so that, when the decompression valve 26 is opened by pressing the operating rod 26*a*, the decompression port 11*a* communicates with the communicating bore 11*c* to allow pressure to escape from the cylinder into the crank casing 10. In addition, the operating rod 26*a* is pointed at the lower end thereof in correspondence with the abutting surface.

Figure 4:
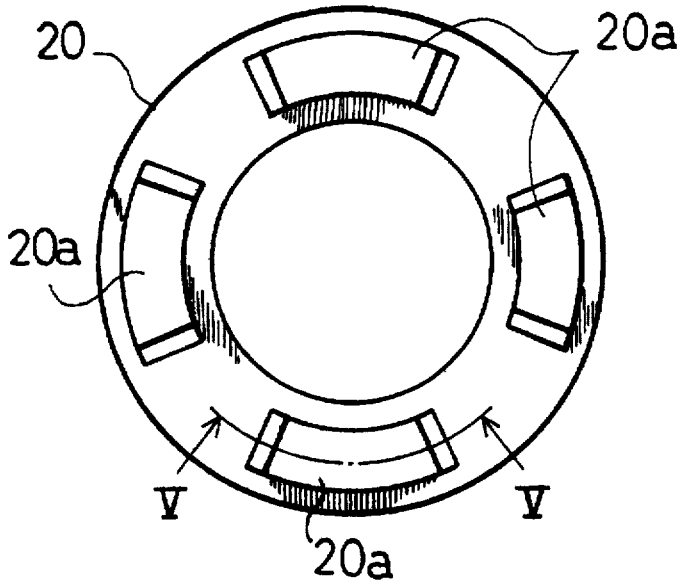
FIG. 4 is a side view of a recoil reel.
Figure 5:
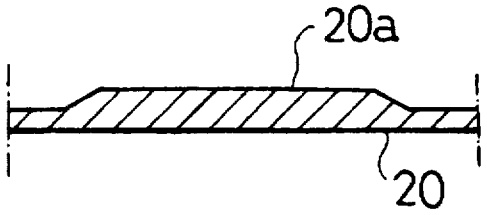
FIG. 5 is a cross-sectional view looking in the direction of the arrows V—V in FIG. 4.
Figure 6:
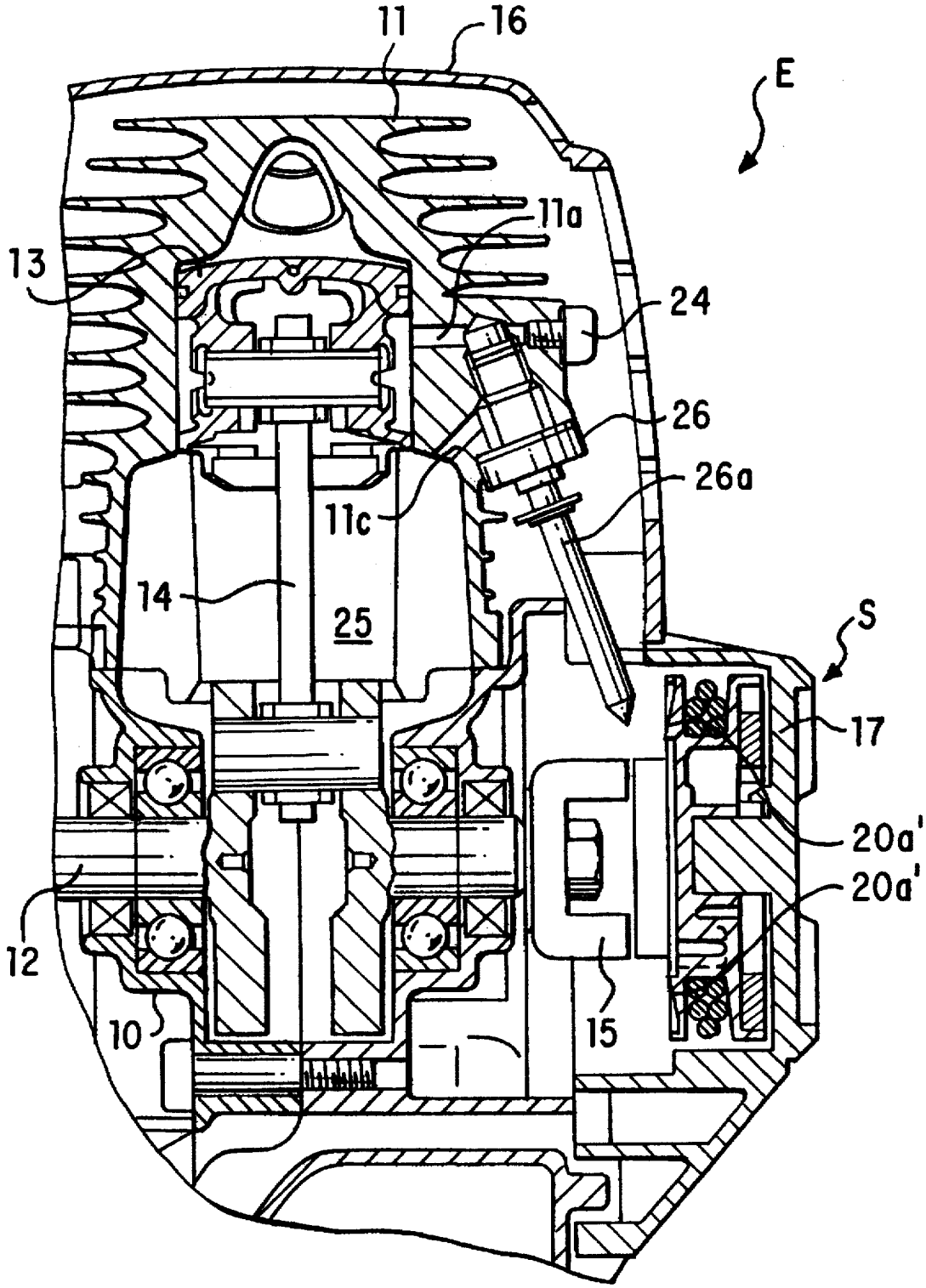
FIG. 6 is a partial cross-sectional front view of an engine of a second embodiment of the present invention.

The operating rod 26*a* is so disposed that the lower end thereof can abut against cams 20*a* formed at the inner surface of the recoil reel 20 (at a side of crank shaft). The cams 20*a*, as shown in FIGS. 4 and 5, project from the side surface of recoil reel 20 and are regularly spaced apart on the same circumference, four cams 26*a* being disposed at every angle of 90° in this embodiment. However the number and positioning of the projections are not limited. As shown in a second embodiment in FIG. 6, the cams 20*a* are changed in formation so as to be slanted cams 29*a*' and the recoil reel 20 is exchanged to change the cams 20*a* in formation or arrangement, whereby the movement of the operating rod 26*a* and the open-close timing thereof can be changed and the recoil reel 20 is easy to start can be mounted to the engine E in correspondence with the kind thereof. In addition, in FIG. 6, like elements corresponding to those in FIG. 1 are indicated by like reference numerals and explanation thereof will be omitted.

When the starting cord 21 is pulled to start the engine E, the recoil reel 20 is rotated to slide toward the crank shaft 12 so as to rotate the crank shaft 12, and simultaneously the cam 20*a* abuts against the lower end of the operating rod 26*a* to push up the rod 26*a* to open the decompression valve 26, so that, when the piston 13 lifts, the inner pressure of the cylinder 11 is, but the compressed pressure escapes into the crank casing 10 through the decompression port 11*a*, decompression valve 26 and communicating bore 11*c*. The crank shaft 12 is easy to rotate so as to obtain a torque when the starting cord 21 is fully pulled, whereby the crank shaft 12 obtains the torque and the slidable member 23 moves toward the recoil casing 17. Hence, the decompression valve 26 closes and the interior of the cylinder 11 is compressed to be heated to a high temperature and the engine is ignited to start.

Figure 8:
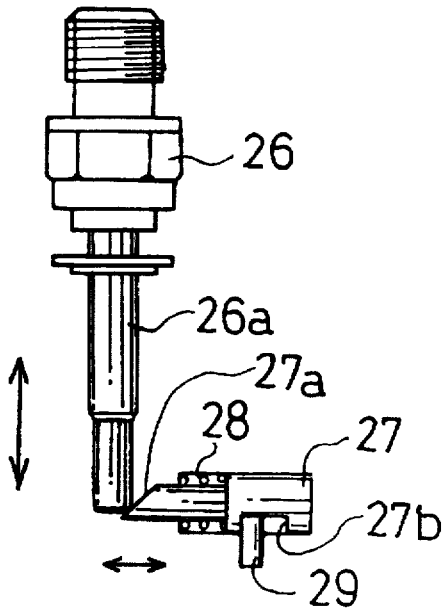
FIG. 8 is an enlarged view of a decompression valve and a transmitting lever in FIG. 7.
Figure 7:
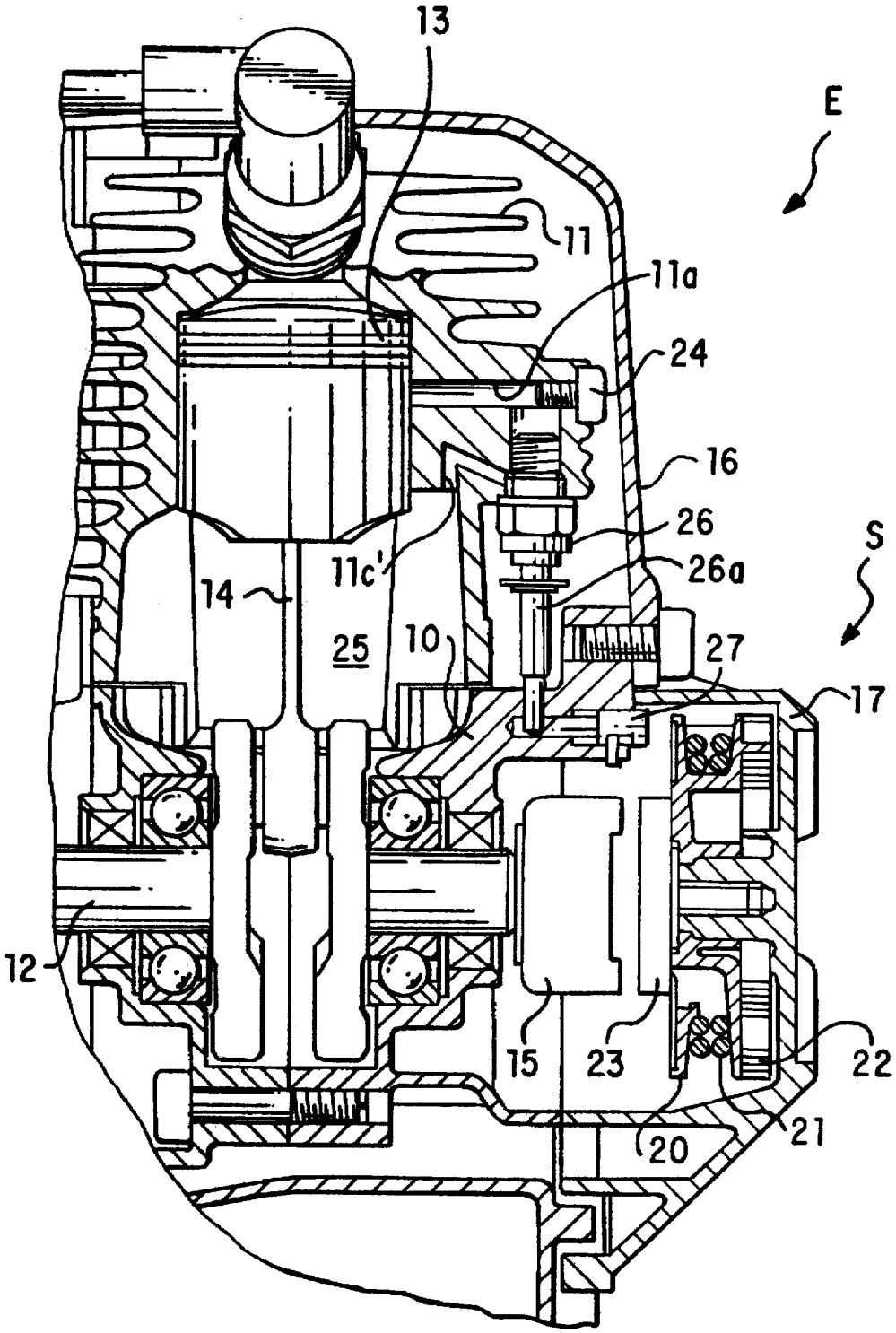
FIG. 7 is a partial cross-sectional front view of an engine of a third embodiment of the present invention.

Referring to FIG. 7 a third embodiment of the present invention is shown having the decompression valve 26, with where like elements corresponding to those in the first embodiment are indicated by like reference numerals and explanation therefor is omitted. In the third embodiment, the decompression valve 26 is vertically disposed so that a decompression port 11*a* and a communicating bore 11*c* are closed or communicated therebetween as described above. An operating rod 28*a* abuts at the lower end thereof against a transmitting lever 27. In brief, as shown in FIGS. 7 and 8, the transmitting lever 27 is inserted into the crank casing 10 from the lateral side thereof so that the transmitting lever 27 abuts at one axial end thereof against the side surface of the recoil reel 20. The transmitting lever 27 is cut on a slant at the other axial end to form a slanted portion 27*a* and inserted into the crank casing 10 such that the lower end of the operating rod 26*a* abuts against the slanted portion 27*a*. Furthermore, the transmitting lever 27 is provided at the lower surface with a recess 27*b* and a check pin 29 is inserted therein from the lower surface of the crank casing 10 so as to prevent the transmitting lever 27 from escaping from the crank casing 10 and also to restrain the same from rotating. A return spring 28 is interposed between the crank casing 10 and a smaller diameter portion of the transmitting lever 27 and fitted thereon so as to bias the transmitting lever 27 to slide toward the recoil reel 20.

In the above-mentioned structure, when the starting cord 21 is pulled, the recoil reel 20 rotates to slide toward the crank shaft 12 so as to abut at the side surface against the transmitting lever 27, moving the slanted portion 27, whereby the operating rod 21*a* is raised to open the decompression valve 26 and the decompression facilitates the rotation of crank shaft 12. Thereafter, the engine starts the same as described above.

Figure 9:
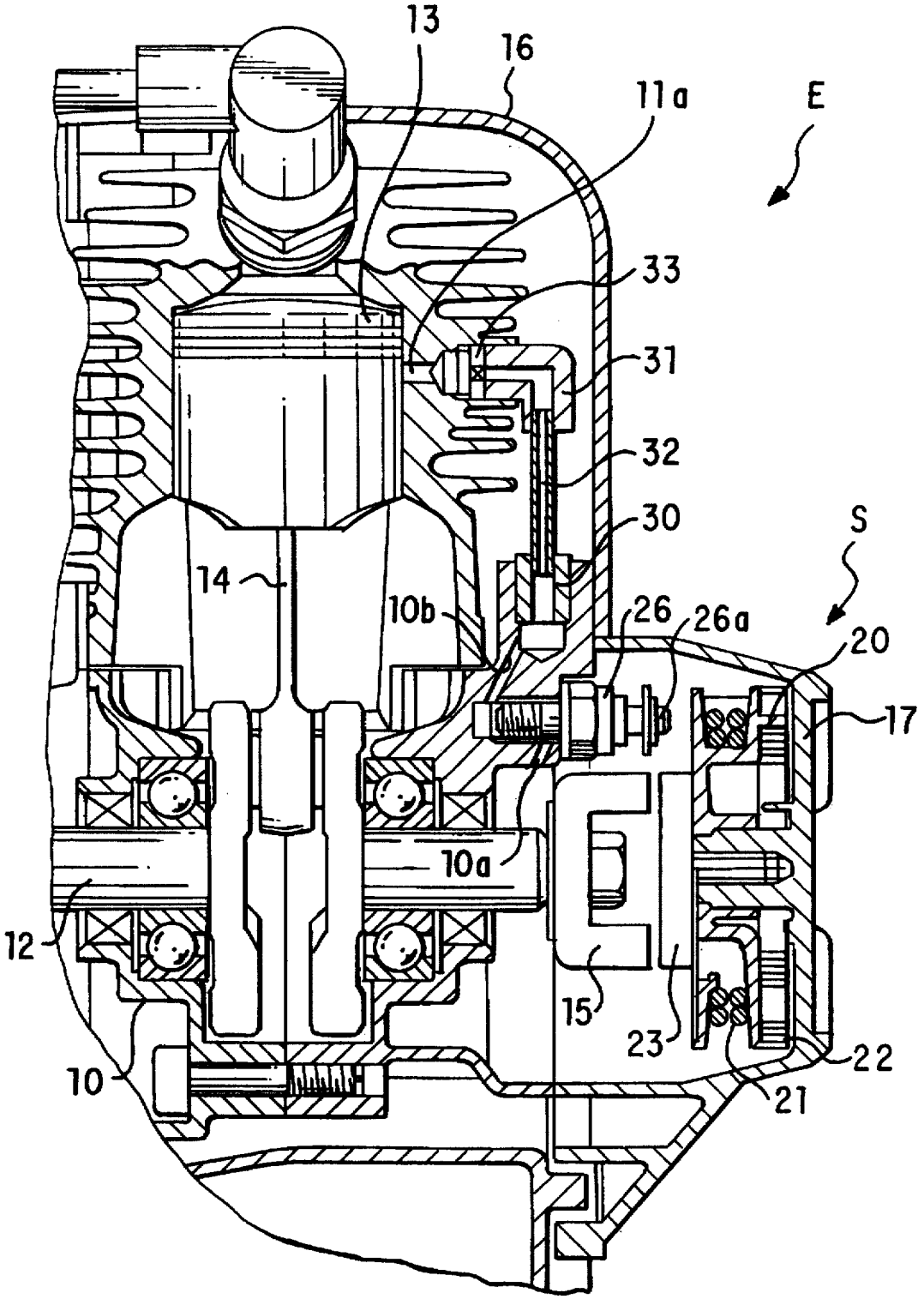
FIG. 9 is a partial cross-sectional front view of the engine of a fourth embodiment of the present invention.
Figure 10:
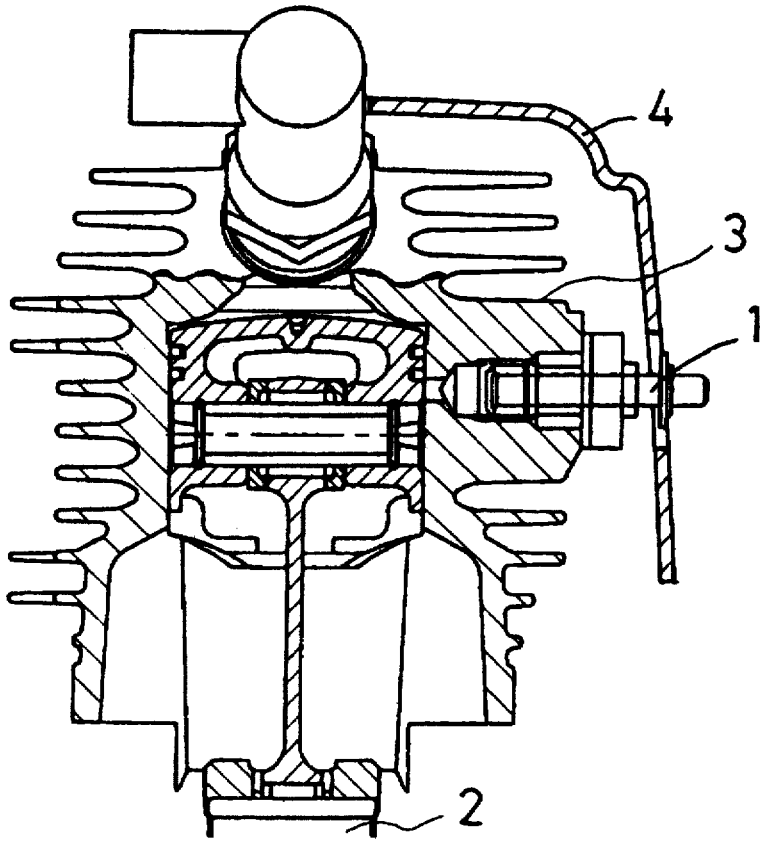
Fig. 10 PRIOR ART
FIG. 10 is a partial cross-sectional side view of an engine disposing a conventional decompressor.

Next, explanation will be given on a fourth embodiment of the invention which disposes the decompression valve in accordance with FIG. 9, where like elements corresponding to those in FIG. 1 are indicated by like reference numerals and explanation thereof is omitted. In the fourth embodiment, a decompression valve 26 is disposed at the side surface of the crank casing 10 horizontally and in parallel to the crank shaft 12 so that an operating rod 26*a* is disposed to directly abut against the side surface of the recoil reel 20. The decompression valve 26 communicates at the secondary thereof with the interior of the crank casing 10 (or the atmosphere) through a communicating bore 10*a* and at the primary with the piping through a communicating bore 10*b*. On the other hand, the decompression port 11*a* is not provided with the plug 24 and communicating bore 11*c*, but a check valve 33 and a joint 31 are inserted into the depression port 11*a* so that the cylinder 11 and crank casing 10 communicate with each other through joints 30 and 31 and a pipe 32.

In such structure, when the starting cord 21 is pulled, the recoil reel 20 rotates and slides toward the crank shaft 12 and abuts at the side surface against the operating rod 26*a*, so that the decompression valve 26 is open. The check valve 33 is open by the compression pressure caused by lifting the piston 13 and the rotation of crank shaft 21, allowing the compression pressure to be released through the joint 31, pipe 32, joint 30 and decompression valve 26, so as to facilitate the rotation of crank shaft 12. The engine E starts combustion when the recoil reel 20 slides to close the decompression valve 26 and the pressure within the cylinder 11 enters into the piping between the check valve 33 and the decompression valve 26. The pressure in the pipe is restrained from entering into the cylinder by the check valve 33, whereby the pressure in the pipe 32 is kept high and a compression ratio is not lowered.

As the discussed above, the present invention is so designed that the decompression valve is disposed vertically with respect to the crank shaft or within the crank casing, thereby not projecting laterally of the cylinder. As a result, there is no need for changing the cowling to prevent interference with the valve, and also an interlocking mechanism of the decompression valve with the recoil starter is simple to construct, thereby enabling a compact engine to be laid out.

Since the recoil starter is of a size in the direction of the crank shaft required only for mounting parts for the recoil starter, the engine width is minimized. Also, the recoil casing requires no cutout so dust which causes failure in the recoil starter is prevented from entering therein.

Since the cam at the recoil reel is made variable correspondingly to the kind of engine, the timing of decompression during the starting is variable so as to enable the most suitable cam to be obtained and variation of the specification is easy.

Although the invention has been described with reference to several different embodiments, these embodiments are merely explanatory and not limiting of the invention which is defined solely by the appended claims.

What is claimed is:

1. A decompressor for an internal combustion engine for escaping compression pressure in a cylinder, comprising:

a decompression valve disposed vertically with respect to a crank shaft and between a cylinder and a crank casing;

said cylinder having a decompression port and a communicating bore for releasing pressure and said decompression valve connecting said decompression port with said communicating bore;

an operating rod for opening said decompression valve to enable said decompression port at said cylinder and said communicating bore to communicate with each other; and cams disposed on a side surface of a recoil reel at a recoil starter, and said operating rod having an end portion disposed proximate said cams, so that said recoil reel, when rotating, slides toward said crank shaft, whereby said cams push said operating rod to open said decompression valve.

2. A decompressor for an internal combustion engine as set forth in claim 1, wherein said cams are made variable in accordance with a type of said internal combustion engine.

3. A decompressor for an internal combustion engine for escaping compression pressure in a cylinder, comprising:

a decompression valve vertically disposed with respect to a crank shaft and between a cylinder and a crank casing;

said cylinder having a decompression port and a communicating bore for releasing pressure and said decompression valve connecting said decompression port with said communicating bore;

an operating rod for opening said decompression valve to enable said decompression port at said cylinder and said communicating bore to communicate with each other; and a transmitting member for slidably engaging and moving said operating rod of said decompression valve, said transmitting member being disposed laterally of a recoil reel, and, said recoil reel, when rotating, being slidable toward said crank shaft so as to actuate said decompression valve by engaging and moving said transmitting member to lift said operating rod.

4. A decompressor for an internal combustion engine for escaping compression pressure in a cylinder, comprising:

a decompression valve disposed in a crank casing;

an operating rod for said decompression valve projecting laterally toward a recoil reel;

a decompression port open in a cylinder, a check valve at said decompression port, and a pipe connecting said decompression port with an input of said decompression valve via said check valve, and said decompression valve having an output open to the atmosphere; and said recoil reel, when rotating, being slidable toward a crank shaft to engage said operating rod to open said decompression valve.

* * * * *